US008814626B2

(12) United States Patent
Smith

(10) Patent No.: US 8,814,626 B2
(45) Date of Patent: Aug. 26, 2014

(54) EXPANDING AND CONTRACTING YO-YO

(76) Inventor: Michael O. Smith, West Hartford, CT (US)

( * ) Notice: Subject to any disclaimer, the term of this patent is extended or adjusted under 35 U.S.C. 154(b) by 177 days.

(21) Appl. No.: 13/488,269

(22) Filed: Jun. 4, 2012

(65) Prior Publication Data

US 2012/0244781 A1 Sep. 27, 2012

Related U.S. Application Data

(63) Continuation-in-part of application No. 12/289,611, filed on Oct. 30, 2008, now abandoned.

(51) Int. Cl.
*A63H 1/30* (2006.01)

(52) U.S. Cl.
CPC ..... *A63H 1/30* (2013.01)
USPC ..... 446/250; 446/249

(58) Field of Classification Search
USPC ..... 446/236, 238, 247, 248, 249, 250, 256, 446/260
See application file for complete search history.

(56) References Cited

U.S. PATENT DOCUMENTS 1,321,836 A * 11/1919 McKenna ..... 446/245
1,419,690 A * 6/1922 Samour ..... 446/248
1,631,539 A * 6/1927 Larrair ..... 446/253
1,783,627 A * 12/1930 Raimondi ..... 446/256
1,793,151 A * 2/1931 Asbury et al. ..... 446/250
2,595,374 A * 5/1952 Studt ..... 446/245
2,667,117 A * 1/1954 Millard et al. ..... 99/418
4,138,939 A * 2/1979 Feld ..... 99/418
4,913,675 A * 4/1990 Wilcox ..... 446/36
5,279,069 A * 1/1994 Myer ..... 47/32
5,349,898 A * 9/1994 Po Wo Cheung ..... 99/417
5,361,536 A * 11/1994 Myer ..... 47/58.1 R
5,487,692 A * 1/1996 Mowrer et al. ..... 446/465
6,776,680 B2 * 8/2004 Chow ..... 446/247
7,740,517 B2 6/2010 Hochstrasser
2009/0130943 A1 * 5/2009 Norman et al. ..... 446/37

* cited by examiner

*Primary Examiner* — Gene Kim
*Assistant Examiner* — Joseph B Baldori
(74) *Attorney, Agent, or Firm* — Richard C Litman

(57) ABSTRACT

The expanding and contracting yo-yo is a spool formed by a pair of disks connected by a narrow diameter pin having a string wound around the pin. At least one, and preferably both, of the disks has a plurality of overlapping wings (also referred to as air foils or leaves) pivotally attached to the periphery of the outer face of the disk. A biasing member causes the wings to remain in a closed dome configuration until the disks begin to spin. When the yo-yo is dropped and pulled back in, centrifugal force, centripetal force, alternate lift and drag of air flow, and resilient bias cause the wings to alternately pivot and unfold outward, followed by pivoting inward to a dome shape. In an alternative embodiment, the wings may be formed with a resilient living hinge that permits the wings to expand and contract against the body of the yo-yo.

15 Claims, 9 Drawing Sheets

EXPANDING AND CONTRACTING YO-YO

CROSS-REFERENCE TO RELATED APPLICATIONS

This application is a continuation-in-part of U.S. patent application Ser. No. 12/289,611, filed Oct. 30, 2008 now abandoned.

BACKGROUND OF THE INVENTION

1. Field of the Invention

The present invention relates generally to toys, and more particularly to an expanding and contracting yo-yo having leaves or air foils on both sides that expand to unfold the leaves and contract to form a dome as the yo-yo string winds and unwinds.

2. Description of the Related Art

The yo-yo is a spool-like toy comprising two substantially rigid disks connected by a dowel pin in the center to which a string is attached. One end of the string is looped around the player's finger so that the toy can be spun out and reeled in by wrist motion. Part of the appeal of the yo-yo is simply the skill of the player in performing certain tricks with the yo-yo. Another part of the appeal is the decorative or ornamental appearance of the yo-yo resulting from the colors or designs of the flat side faces of the yo-yo as the string winds and unwinds, and as the spool spins at the end of the string when fully extended.

In order to maintain the popularity of the yo-yo and commercial demand for the yo-yo, however, there is a continuing need for developing new visual effects to attract attention to the yo-yo. Thus, an expanding and contracting yo-yo solving the aforementioned problems is desired.

Thus, an expanding and contracting yo-yo solving the aforementioned problems is desired.

SUMMARY OF THE INVENTION

The expanding and contracting yo-yo is a spool formed by a pair of disks connected by a narrow diameter pin having a string wound around the pin. At least one disk, and preferably both of the disks, has a plurality of overlapping wings (also referred to as air foils or leaves) pivotally attached to the periphery of the outer face of the disk. The wings are capable of expanding outward to unfold like the petals of a flower and contracting to form a dome on the outer face, similar to a closed flower bud. The yo-yo has a flexible, resilient loop attached to the inner face of the wings to bias the wings to the closed dome configuration. When the yo-yo is dropped and pulled back in, centrifugal force, centripetal force, alternate lift and drag of air flow, and resilient bias cause the wings to alternately pivot and unfold outward, followed by pivoting inward to reform the dome shape. In an alternative embodiment, the wings may be formed with a resilient living hinge that permits the wings to expand and contract against the body of the yo-yo.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
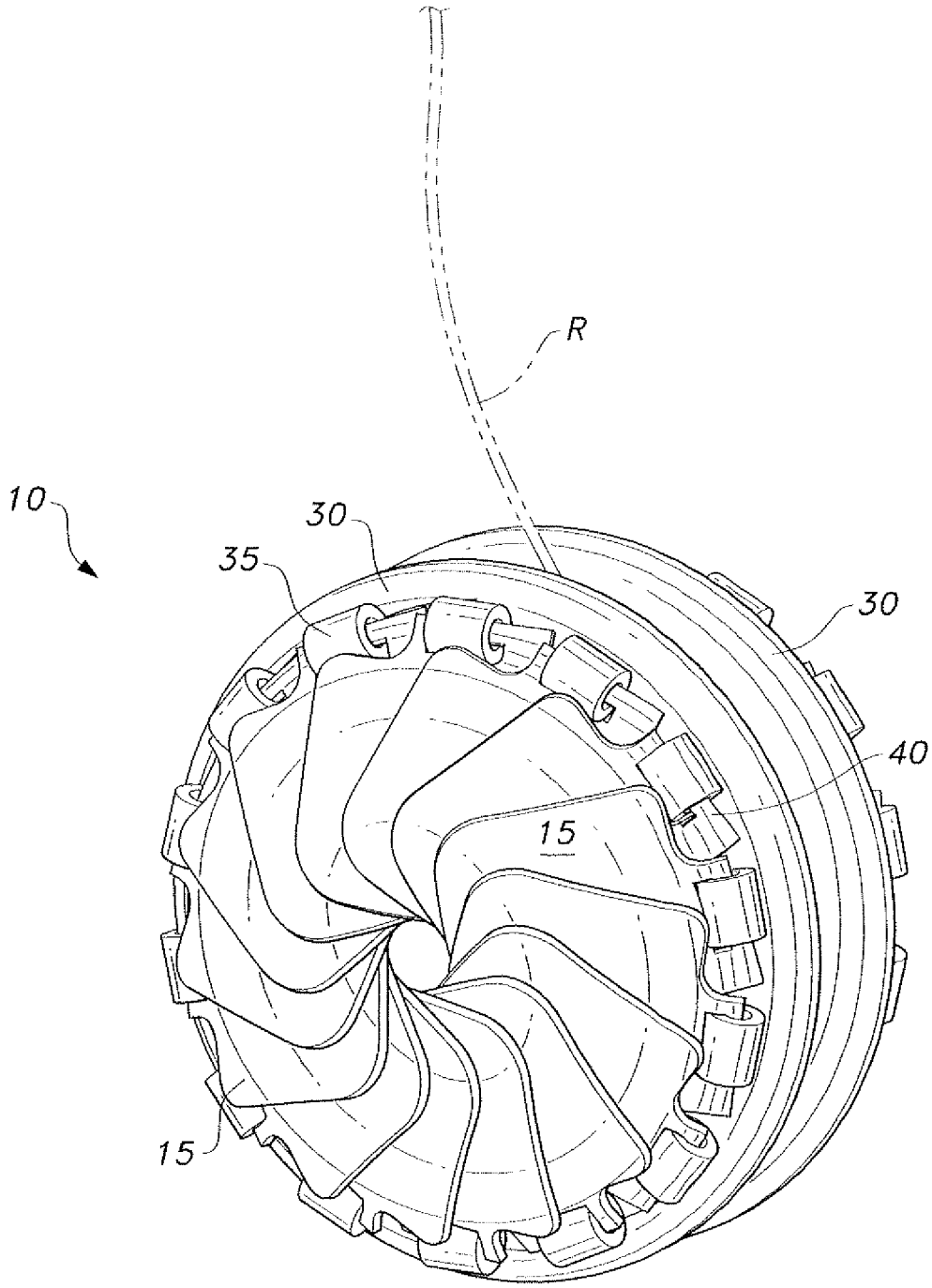
FIG. 1 is an environmental, perspective view of an expanding and contracting yo-yo according to the present invention.

As shown in FIGS. 1-4, in a first embodiment, the expanding and contracting yo-yo 10 has a plurality of overlapping wings 15 pivotally to the periphery of at least one disk 30, and preferably both disks 30, on each side of the yo-yo 10. The wings 15, also referred to as air foils or leaves, pivot outwardly to an open, expanded position as the string R unwinds, and pivot inwardly to a contracted, domed position as the string R rewinds or when the yo-yo assumes a stationary position. Moreover, adjacent wings 15 may be designed to have contrasting color schemes, textures, or the like. Preferably, the wings 15 define a dome having an open axial center region when the wing members 15 are in a closed configuration, although the wings 15 may pivot to a flat position substantially coplanar with the rim of the disk 30 or parallel to the rigid outer face or hub of the disk 30.

In a most general form, yo-yo 10 is a spool having two disks or disk-like members 30 made from wood, plastic, metal, composite materials, or the like, which are connected by a dowel pin D at their axial center, and a string R attached to and wound around the dowel pin D. One end of the string has a loop L that the player's finger or other extremity can engage so that the toy can be spun out and reeled in by wrist, or other appropriate motion. Often yo-yos are manufactured so that the disks 30 extend laterally into domes to provide greater stability of motion, better aerodynamics, and enhanced aesthetic appeal to the design. Other yo-yo designs are possible. For example, the disks may be hollowed out to form cup-shaped wheels, and a decorative outer plate may be snapped or adhered to the rim of the wheels. The dowel pin may be replaced by a hollow axle joining the disks, the string being attached to the hollow axle.

In addition to the general yo-yo design, yo-yo 10 includes a plurality of multiple overlapping wings 15 pivotally attached to the periphery of disks 30 on each side of yo-yo 10. The wings 15 are resiliently biased to the contracted dome position by a flexible, resilient member 52, which is preferably formed into a loop and attached to each of the wings 15. The flexible resilient member may be an elastic band, a rubber band, an elastic cord made from a material similar to pony tail loops or bungee cords, etc. Each resilient member may be looped through a plurality of tubular band retainers 50, each band retainer 50 being disposed on a respective wing member 15 radially outward from a pivot point formed by the attachment of pivot pin 40 of winged member 15 to hinge tube 35 peripherally disposed on disk 30. Wings 15 may be pivotally attached to the periphery of disk 30 in any desired manner, including by a living hinge, mechanical hinge, etc. The configuration of band retainers 50 on winged members 15 causes the winged members to be normally closed absent rotational movement of yo-yo 10. When a user rotates the yo-yo 10, the resilient bias provided by flexible, resilient member 52 is overcome by centrifugal force and lift from airflow to thereby open the hinged wings 15. When the yo-yo 10 is rewound, centripetal force, air drag, and the resilience of resilient member 52 return the wings 15 to their resting position against disks 30.

Figure 2:
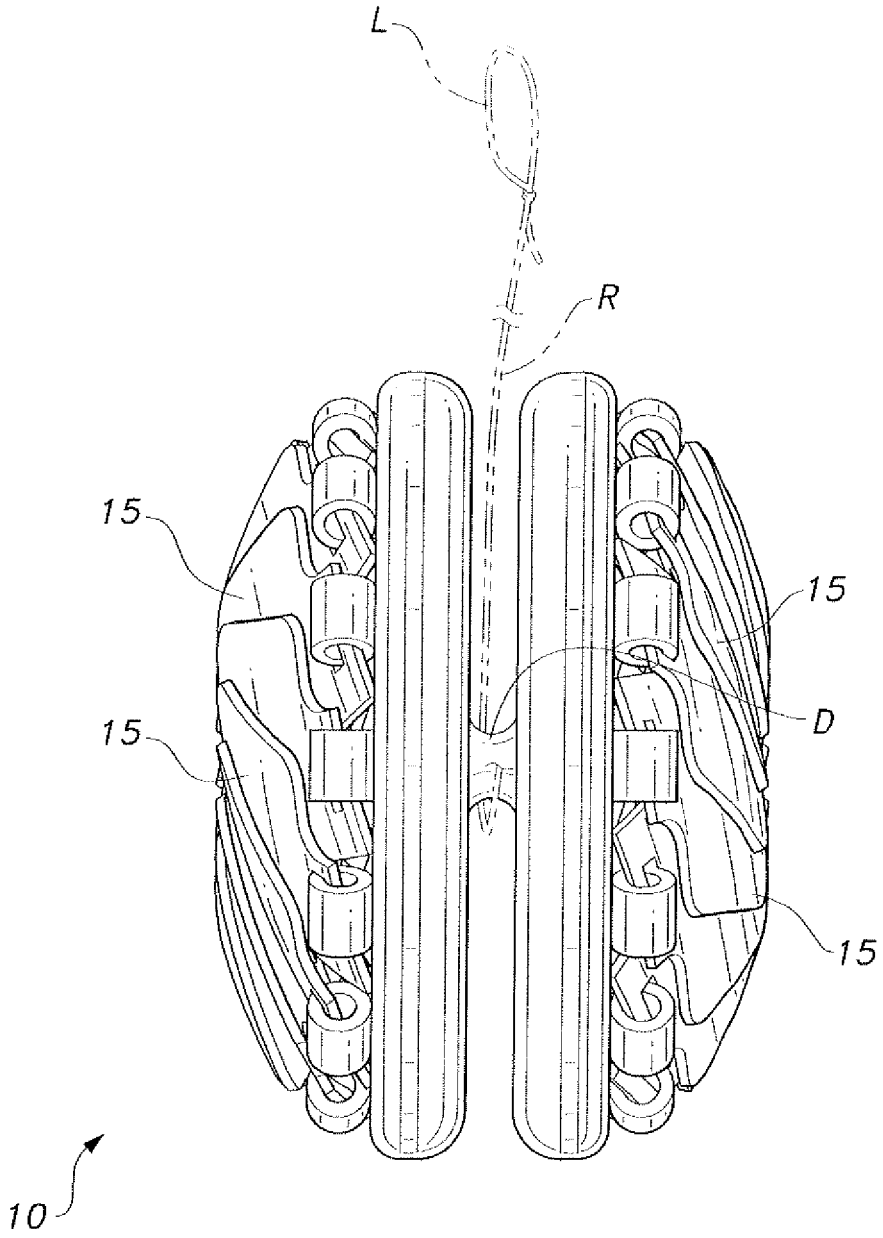
FIG. 2 is a top view of the expanding and contracting yo-yo according to the present invention.
Figure 3:
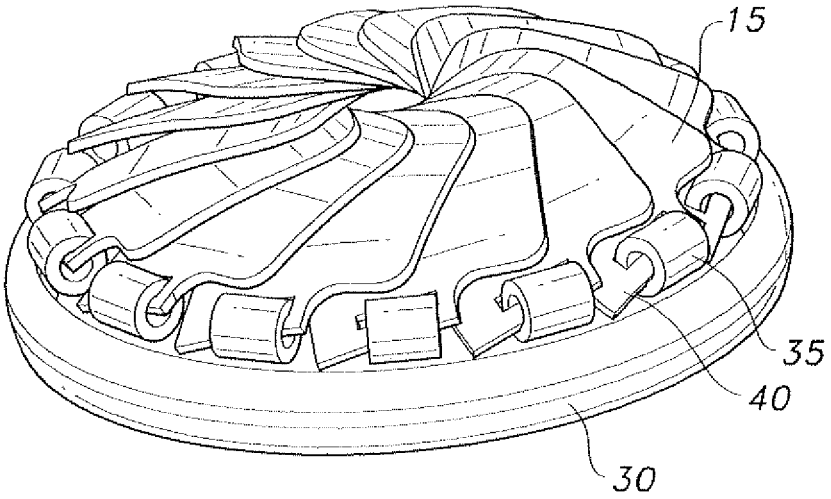
FIG. 3 is a perspective view of a single disk of an expanding and contracting yo-yo according to the present invention, showing the wings contracted.
Figure 4:
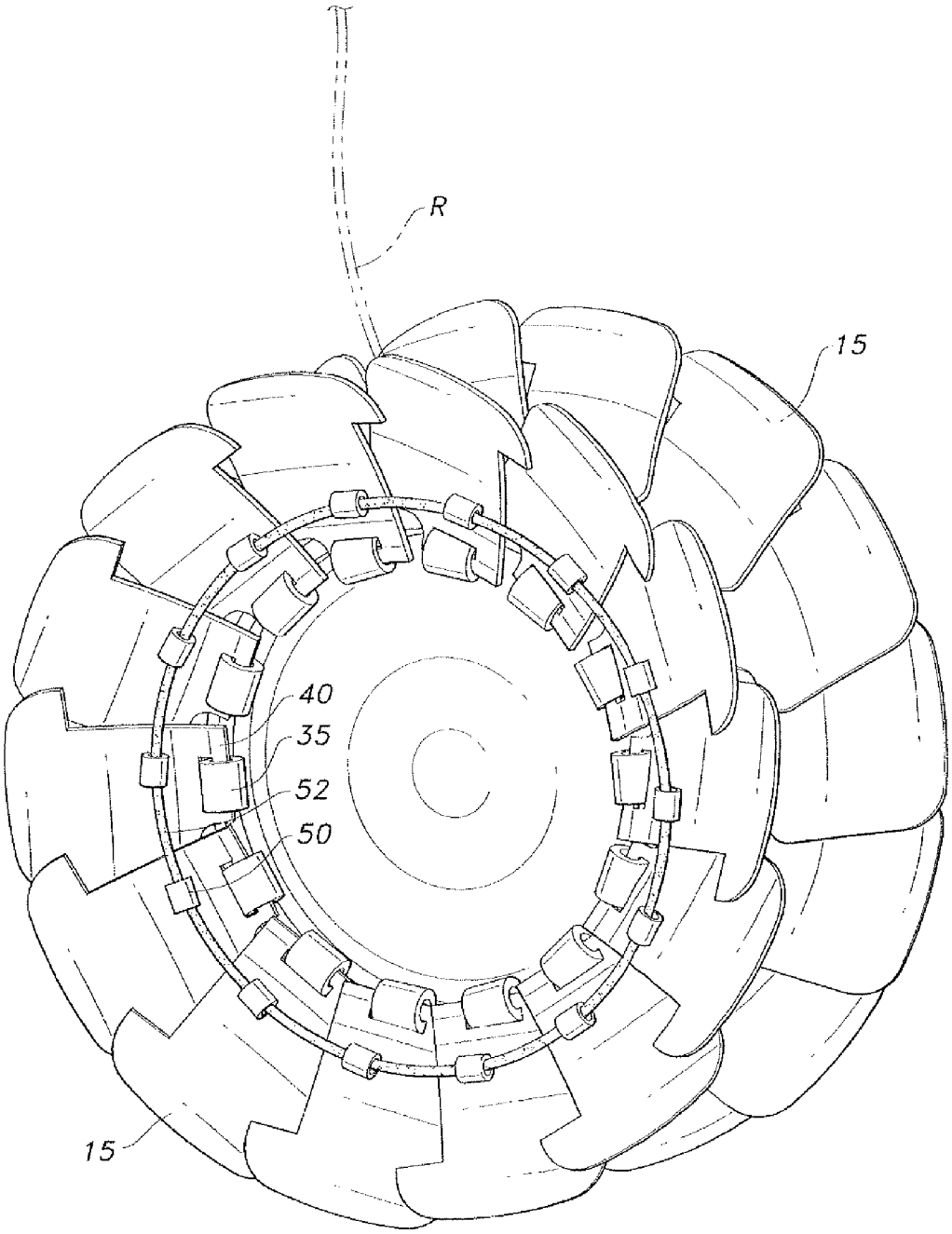
FIG. 4 is a perspective view of an expanding and contracting yo-yo according to the present invention, showing the wings expanded.
Figure 5:
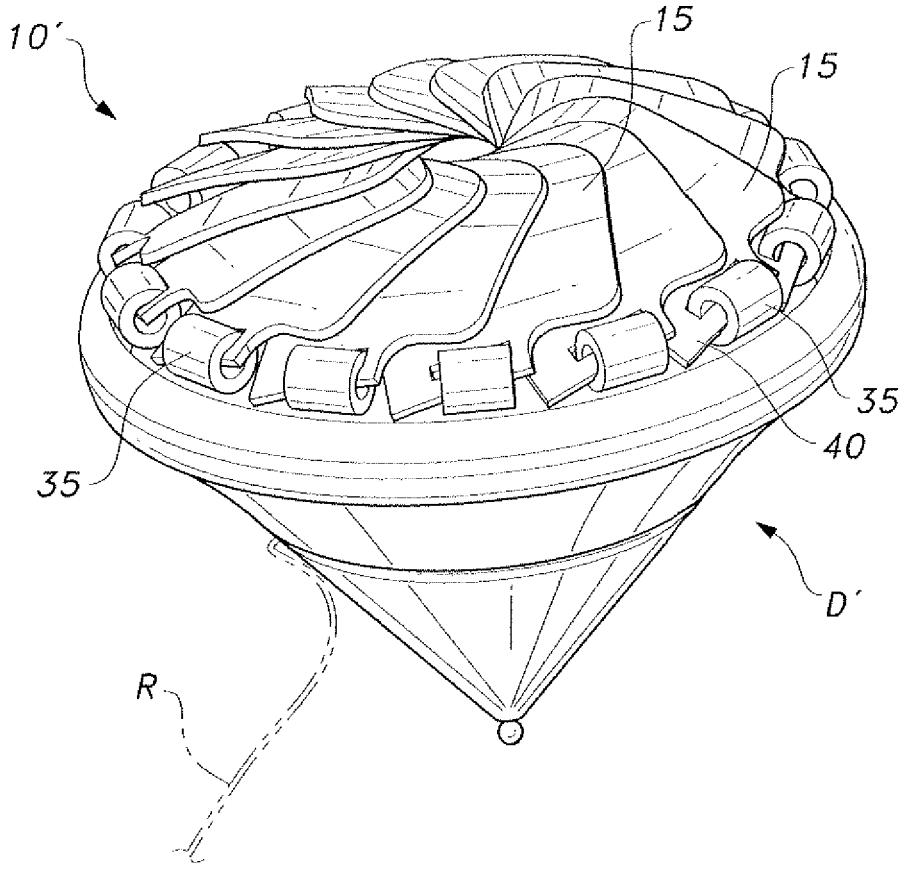
FIG. 5 is an alternative embodiment comprising a spinning top according to the present invention.
Figure 6:
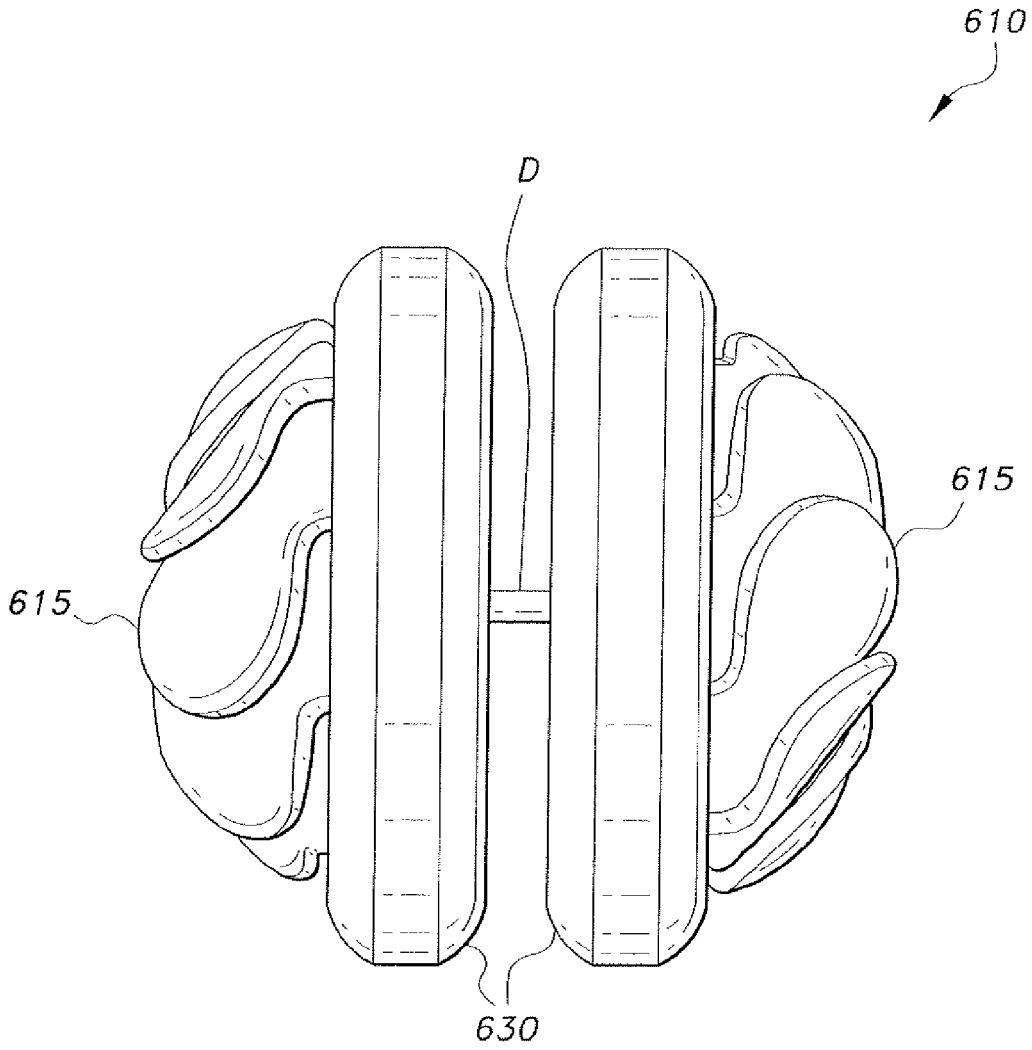
FIG. 6 is a top view of an alternative embodiment of an expanding and contracting yo-yo according to the present invention, the string being omitted.
Figure 7:
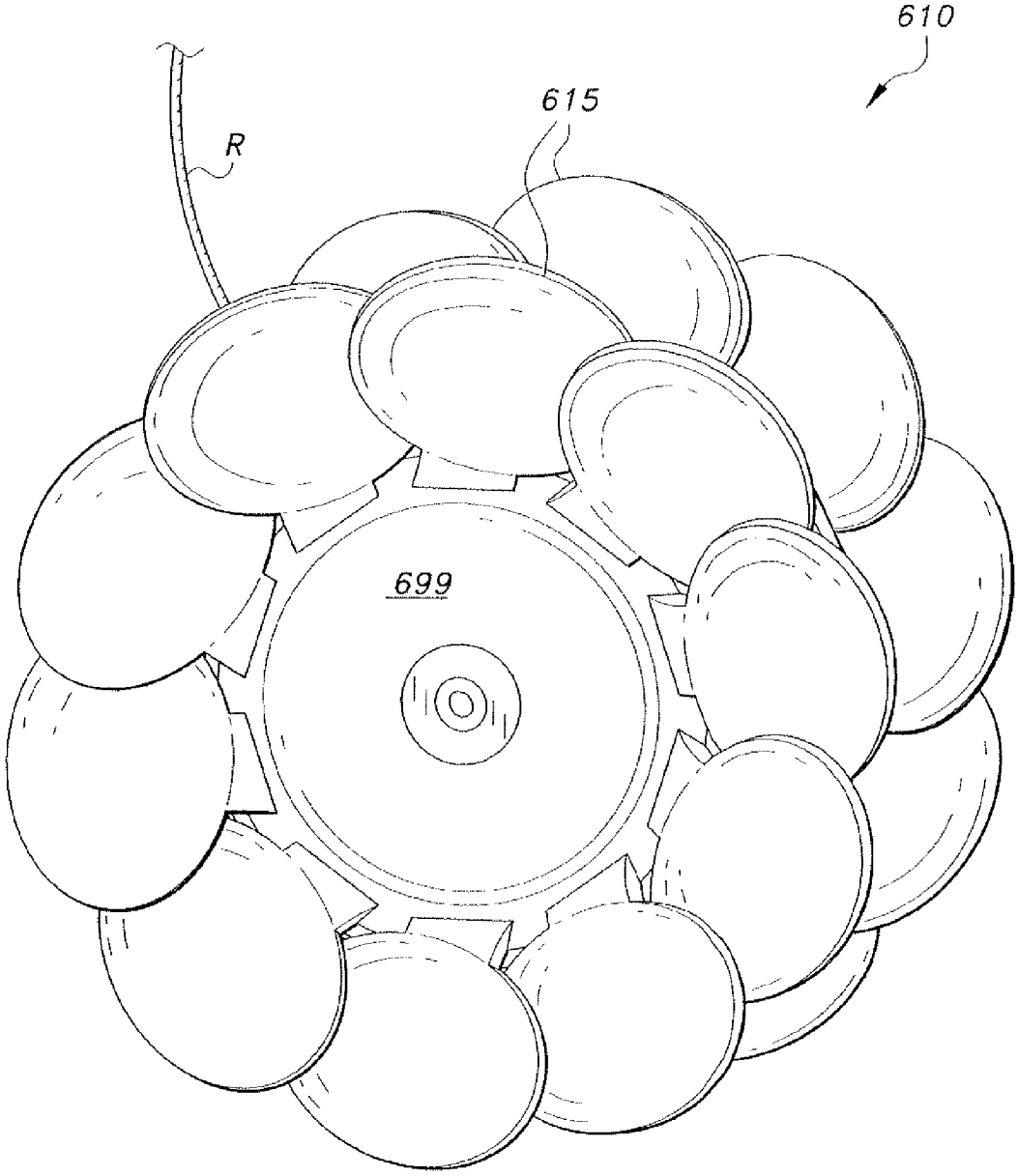
FIG. 7 is a perspective view of the expanding and contracting yo-yo of FIG. 6, showing the wings in an open position.

FIG. 5 shows a spinning top 10' having overlapping wings 15 similar to the yoyo of FIG. 2. The dowel pin D has been replaced by a tapered body D'. The spinning top 10' incorporates a pull string coming out of tapered body D' in a conventional manner. When the top 10' is thrown and the pull string is pulled and disengaged from the top 10', the spinning motion of the top allows the overlapping wings 15 to expand as described in the aforementioned embodiment 10. Thus, it can be seen that many types of spinning devices can be fashioned while incorporating a plurality of spring biased overlapping wings, which are centrifugally reactive to cause the wings to expand open when the device is spinning. These devices include, for example without limitation, flying or spinning discs, domes, tops, gyroscopic tops, and other types of rotating, spinning or whirling devices.

As shown in FIGS. 6-9, an alternative embodiment of the expanding and contracting yo-yo has an alternative means for biasing the wings in a closed position, yet allowing for their expansion due to the centripetal forces of a spinning toy. In this version of the toy, the expanding and contracting yo-yo 610 has a plurality of overlapping wings 615 disposed along the periphery of at least one disk 630, and preferably both disks 630, on each side of the yo-yo 610. The wings 615, also referred to as air foils or leaves, pivot outwardly to an open, expanded position as the string R unwinds, and pivot inwardly to a contracted, domed position as the string R rewinds, or when the yo-yo assumes a stationary position. Preferably, the wings 615 define a dome having an open axial center region when the wing members 615 are in a closed configuration, although the wings 615 may pivot to a flat position substantially coplanar with the rim of the disk 630 or parallel to the rigid outer face of the disk 630.

In a most general form, the yo-yo 610 is a spool having two disks or disk-like members 630 made from wood, plastic, metal, composite materials, or the like, which are connected by a dowel pin D at their axial center, and a string R attached to and wound around the dowel pin D. One end of the string has a loop L (seen in FIG. 2) that the player's finger or other extremity can engage so that the toy can be spun out and reeled in by wrist motion. Often, yo-yos are manufactured so that the disks 630 extend laterally into domes to provide greater stability of motion, better aerodynamics, and enhanced aesthetic appeal to the design. Other yo-yo designs are possible. For example, the disks may be hollowed out to form cup-shaped wheels, and a decorative outer plate may be snapped or adhered to the rim of the wheels. The dowel pin may be replaced by a hollow axle joining the disks, the string being attached to the hollow axle.

Figure 8:
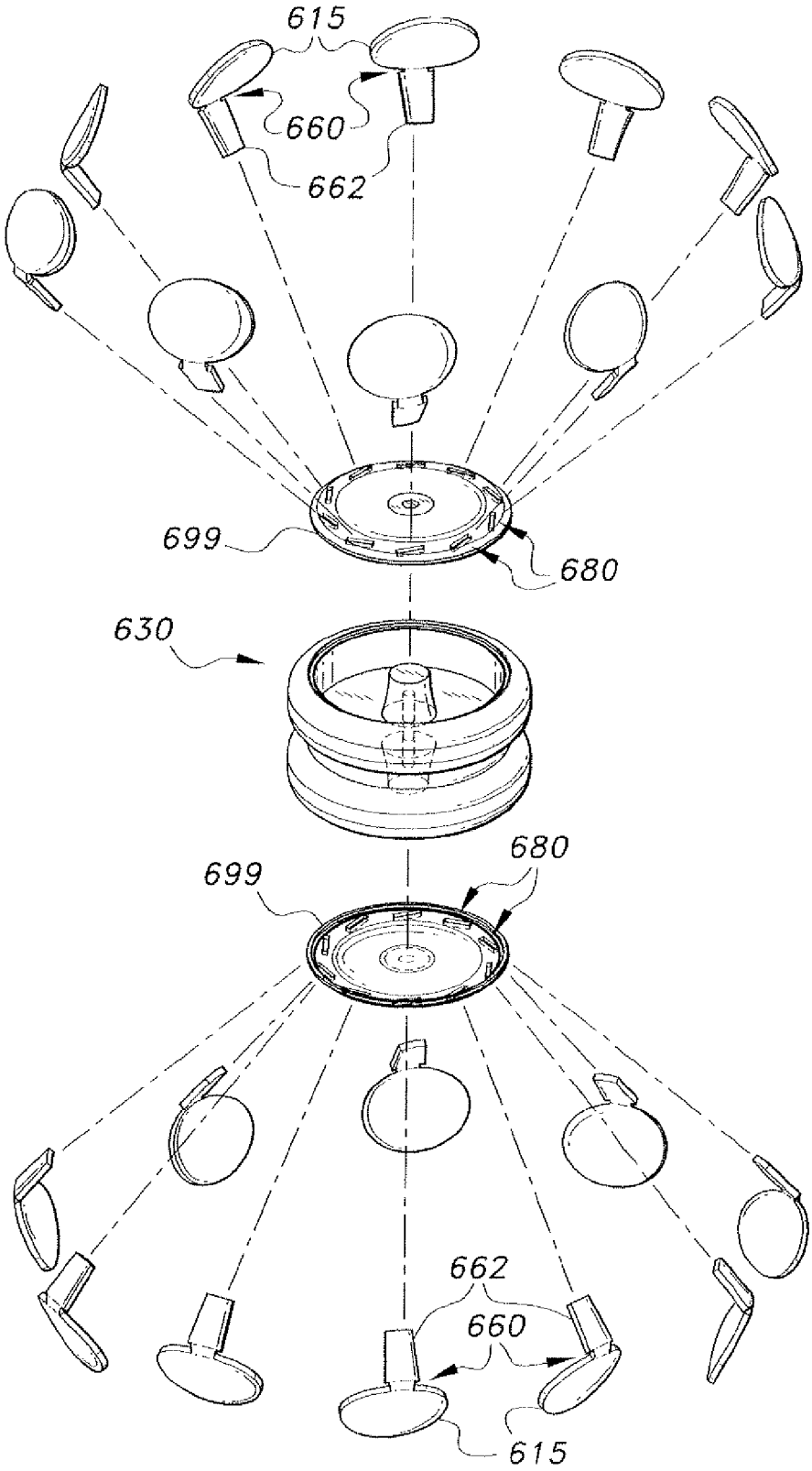
FIG. 8 is a partially exploded perspective view of the spool of the expanding-contracting yo-yo of FIG. 6.
Figure 9:
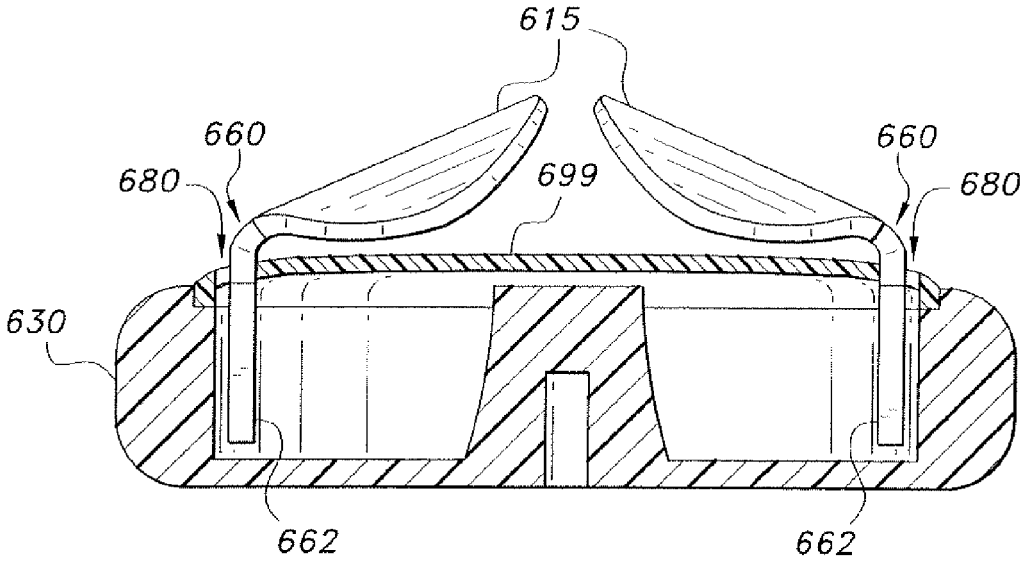
FIG. 9 is a side view in section of a single disk of the expanding and contracting yo-yo of FIG. 6.

In addition to the general yo-yo design, the yo-yo 610 includes a plurality of multiple overlapping wings 615 attached to the periphery of the disks 630 on each side of the yo-yo 610. Referring to FIGS. 8 and 9, the wings 615 have a substantially round or ovoid head attached to a substantially trapezoidal, elongate mounting tab 662 by a neck. The head normally extends from the tab 662 at an obtuse angle. However, the neck is thinned so that it forms a living hinge 660. The head is not flat, but has an arcuate curvature that permits the heads of the wings 615 to overlap when the yoyo 610 is at rest, and imparting the properties of an airfoil to the wings 615. The mounting tabs 662 are press fit into slots 680 that are spaced apart about the periphery of the outer cover plate 699 of the disk. The slots 680 do not extend normal to the radii of the outer cover plate 699, but are obtuse to the radii of the outer cover plate 699, thereby enhancing the overlapping effect of the heads of the wings 615, which ensures that the wings 615 will not interfere or clash with each other when they expand or pivot outward from the disk, but will form a dome when contracted against the face of the disk. The living hinges 660 have a thickness such that the heads of the wings 615 are normally resiliently biased to a domed configuration against the outer face or hub 699 of the disk, but are sufficiently flexible to permit the heads of the wings 615 to pivot outward due to the combination of centrifugal force, centripetal force, and the difference in air pressure or lift across the surface and on opposite sides of the arcuate heads of the wings 615 when the yoyo 610 is dropped from a height. The living hinge 660 may be slightly above the face of the outer cover plate 699 when the mounting tabs 662 are fully inserted into the slots 680 in order to ensure free rotation or pivoting of the heads of the wings 615. The wings 615 may be made from plastic.

When a user rotates the yo-yo 610, the resilient bias provided by the living hinges 660 is overcome by centrifugal force and lift from airflow to thereby open the hinged wings 615. When the yo-yo 10 is rewound, centripetal force, air drag, and the resilience of living hinge 660 return the wings 615 to their resting position proximate the surfaces of the disks 630.

It is to be understood that the present invention is not limited to the embodiments described above, but encompasses any and all embodiments within the scope of the following claims.

I claim:

1. An expanding and contracting yo-yo, comprising:

a pair of disks, each of the disks having a periphery, an outer face, and an axial center;

a cross member connecting the axial centers of the disks to form a spool;

a string attached to and wound around the cross member, the string having an end formed into a finger loop;

a plurality of overlapping wings attached to at least one of the disks, the wings being pivotal and unfolding to an expanded position extending from the periphery of the disk and folding to a contracted position against the outer face of the disk;

a circular outer cover plate forming the outer face of the at least one of the disks, the outer cover plate having a plurality of slots defined therein, the slots being spaced apart radially around the cover plate, the wings extending from the slots, the slots extending at an angle so that the wings overlap in the contracted position; and wherein each of said wings comprises a head, a mounting tab, and a neck joining the head to the mounting tab, the neck being thinned to form a resilient, flexible living hinge, the mounting tabs being press fit into the slots in the outer cover plate so that the living hinge extends slightly above the outer cover plate, the resilient living hinge biasing the wings to the contracted position.

2. The expanding and contracting yo-yo according to claim 1, wherein the head of each of the wings is arcuately curved to form an airfoil.

3. The expanding and contracting yo-yo according to claim 1, wherein each of the disks has a plurality of said wings attached thereto.

4. The expanding and contracting yo-yo according to claim 3, wherein said wings form a dome shape in the contracted position.

5. The expanding and contracting yo-yo according to claim 3, wherein each of said wings has a resilient living hinge biasing the wings to the contracted position, the living hinge pivoting to unfold said wings to the expanded position.

6. The expanding and contracting yo-yo according to claim 1, wherein said cross member comprises a dowel pin.

7. The expanding and contracting yo-yo according to claim 1, wherein said cross member comprises a hollow axle.

8. An expanding and contracting yo-yo, comprising:

at least two disks, each of the disks having a periphery, an outer face and an axial center;

a dowel connecting the axial centers of the disks to form a spool;

a string attached to and wound around the dowel pin, the string having an end formed into a finger loop;

a plurality of overlapping wings pivotally attached to the periphery of at least one of the disks, the wings unfolding to an expanded position extending from the periphery of the disk and folding to a contracted position against the outer face of the disk; and a continuous flexible, resilient member attached to the wings at a location radially outward from the pivotal attachment, the resilient member resiliently biasing the wings to the contracted position.

9. The expanding and contracting yo-yo according to claim 8, wherein said wings define a dome when in the contracted position.

10. The expanding and contracting yo-yo according to claim 8, wherein each of said wings has a pivot pin extending therefrom and said at least one disk has a plurality of hinge tubes disposed about its periphery, each of the pivot pins being rotatable in a respective one of the hinge tubes.

11. The expanding and contracting yo-yo according to claim 8, wherein said at least two disks consists of two disks.

12. The expanding and contracting yo-yo according to claim 11, wherein said wings are pivotally attached to both of said two disks.

13. The expanding and contracting yo-yo according to claim 8, wherein said continuous flexible, resilient member comprises a loop.

14. The expanding and contracting yo-yo according to claim 8, wherein said continuous flexible, resilient member comprises an elastic band.

15. An expanding and contracting dome, comprising:

at least one disk having a periphery, an outer face and an axial center;

a plurality of overlapping wings pivotally attached to the periphery of the at least one disk, the wings unfolding to an expanded position extending from the periphery of the disk and folding to a contracted position against the outer face of the disk;

a continuous flexible, resilient member attached to the wings at a location radially outward from the pivotal attachment, the resilient member resiliently biasing the wings to the contracted position; and wherein when the disk is spun the resilient bias provided by flexible, resilient member is overcome by centrifugal force to thereby open the pivotally attached wings, and as the spinning disk slows down the resilient bias provided by flexible, resilient member overcomes the centrifugal force to thereby close the pivotally attached wings.

* * * * *